United States Patent [19]

Morokawa

[11] 4,003,198

[45] Jan. 18, 1977

[54] ELECTRONIC TIMEPIECE

[75] Inventor: Shigeru Morokawa, Higashiyamato, Japan

[73] Assignee: Citizen Watch Co., Ltd., Tokyo, Japan

[22] Filed: Oct. 31, 1974

[21] Appl. No.: 519,557

[30] Foreign Application Priority Data

Nov. 13, 1973 Japan ..... 48-127481

[52] U.S. Cl. ..... 58/152 R; 58/23 AC; 58/23 BA; 58/38 R; 58/152 B

[51] Int. Cl.[2] ..... G04C 21/16; G04C 3/00

[58] Field of Search ..... 58/23 R, 23 BA, 38, 58/152 R, 152 B, 50 R; 307/51; 320/6

[56] References Cited

UNITED STATES PATENTS 3,714,867 2/1973 Dargent ..... 58/50 R

FOREIGN PATENTS OR APPLICATIONS 1,257,964 2/1961 France ..... 58/23 BA

*Primary Examiner*—E. S. Jackmon

*Attorney, Agent, or Firm*—Sherman & Shalloway

[57] ABSTRACT

An electronic timepiece comprising a connecting system for connecting a plurality of electronic cells in parallel without undesirable mutual influences such as mutual charging and discharging.

11 Claims, 4 Drawing Figures

ELECTRONIC TIMEPIECE

BACKGROUND OF THE INVENTION

1. Field of the Invention

This invention relates to an electronic timepiece and more particularly to an electronic timepiece driven by the electric power from a plurality of electric cells.

2. Technical Considerations and Prior Art

Many attempts have been made to provide an electronic timepiece having a plurality of electric batteries or cells for the purpose of obtaining increased electric power. However, there are problems in mutual charging or discharging and in increased power consumption when using features in addition to the usual fundamental timepiece function, when two or more cells are connected in parallel.

On the other hand, the parallel connection of cells can be advantageous in the facts that the handling of signals can be done at a lower voltage due to the increase in the current level without a change in the voltage and therefore the timepiece can include many additional functions and features.

SUMMARY OF THE INVENTION

A primary object of this invention is to provide an electronic timepiece which has improved reliability and a long continuous working period by solving the above-described problems associated with the parallel connection of electric batteries or cells.

In the electronic timepiece according to this invention, the terminal voltages of each cell are detected. Furthermore, the levels of power consumption in each of the components or sections of the timepiece are determined and the resulting levels are used to set the paths of the electric current from the cells to the components.

The principle of this invention may be applied to timepiece having a single cell as well as one of the countermeasure in that the continuous time display function is changed to the intermittent function in order to decrease the power consumption when the current flow to the time display mechanism increases to a higher level than of normal conditions.

The timepiece of this invention may be constituted so that the main component of the timepiece is formed separately from optional means or optional attachments, such as alarm devices with one or more electric cells. Such construction can meet with the various requirement by the user.

Discussing now the capacity of cells, the improved cells such as a mercury or silver cells which have a terminal voltage of about 1.5 volts and a capacity of 200 mA per hour can drive continuously the main component of an electronic timepiece for one to three years with the average current flow of 5 to 15 $\mu$A. On the other hand, a typical buzzer for alarm requires the working current to flow at about 1 to 5 mA at 1.5V, so that the electronic timepiece having a buzzer can be driven only 20 to 200 hours.

One of the most rational approaches is to provide two groups of cells, one being used for the main component and the other for an optional or additional component such as an alarm and being used to connect the cells of the groups to each other in a suitable manner, thereby improving reliability by using the power from the cells at a desirable distribution ratio between the main and optional components.

Examples of the optional components which can be used in the timepiece according to this invention include alarm devices, high accuracy time pace signal generators, automatic time correcting devices, calculating means, paging devices, data bank devices and a schedule timer devices.

DETAILED DESCRIPTION OF THE INVENTION

Figure 1:
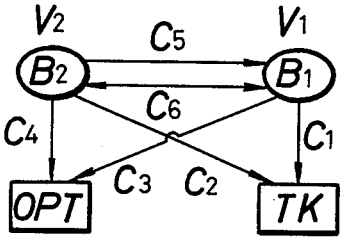
FIG. 1 is a diagram showing the paths of electric current between electric cells, a main component and optional component of the electronic timepiece according to this invention.

Referring to the drawing, FIG. 1 shows schematically the possible paths electric current between time keeping means TK, an optional componet OPT and a pair of electric cells $B_1$ and $B_2$. The term "time keeping means" is intended to mean a main component or section of the timepiece which may comprise a time pace signal generator, a time unit signal generator and a time display mechanism. Assuming that the time keeping means TK consumes a relatively small power at the constant rate and that the optional means consumes a relatively large amount of power on demand, the relation between the connections $C_1$, $C_2$. . . $C_6$ is that it is advantageous to use the optional meams OPT and the cell $B_2$ together with the time keeping means TK and the cell $B_1$ in the operation of the timepiece under such condition that the operation of the time keeping device according to preference is given in the following Table 1.

Table 1

| Functions of State | | Values of Functions | | | | | | Notes |
|---|---|---|---|---|---|---|---|---|
| $J_1 = 1 : V_2 - V_1 > \Delta V$ | $J_1$ | 0 | 0 | 0 | 0 | 1 | 1 | $B_1$ consumed |
| $J_2 = 1 : V_1 - V_2 > \Delta V$ | $J_2$ | 0 | 0 | 1 | 1 | 0 | 0 | $B_2$ consumed |
| $J_3 = 1$ : OPT demanded in operation | $J_3$ | 0 | 1 | 0 | 1 | 0 | 1 | |
| $J_4 = 1$ : TK demanded in operation | $J_4$ | 1 | 1 | 1 | 1 | 1 | 1 | |
| Functions of Connections | | | | | | | | Routes |
| $C_1 = 1 : B_1 \rightarrow TK$ | $C_1$ | 1 | 1 | 1 | 1 | 0 | 0 | regular route |
| $C_2 = 1 : B_2 \rightarrow TK$ | $C_2$ | (1) | (1) | 0 | 0 | 1 | 1 | auxiliary route |
| $C_3 = 1 : B_1 \rightarrow OPT$ | $C_3$ | 0 | 0 | 0 | 0 | 0 | 0 | auxiliary route |
| $C_4 = 1 : B_2 \rightarrow OPT$ | $C_4$ | 0 | 1 | 0 | (0) | 0 | (1) | regular route |
| $C_5 = 1 : B_2 \rightarrow B_1$ | $C_5$ | 0 | 0 | 0 | 0 | 0 | 0 | charging-discharging route |

Table 1-continued

| Functions of State | Values of Functions | | | | | | Notes |
|---|---|---|---|---|---|---|---|
| $C_6 = 1 : B_1 \rightarrow B_2$ | $C_6$ | 0 | 0 | 0 | 0 | 0 | 0 | charging-discharging route |
| States | | a | b | c | d | e | f | |

In Table 1,

State *a* represents a state in which a power to TK is supplied from only $B_1$ or can be supplied from both $B_1$ and $B_2$.

State *b* represents a state in which power to OPT is supplied from only $B_2$.

State *c* represents a state in which $B_1$ is consumed and a power to TK is supplied from $B_1$.

State *d* represents a state in which $B_2$ is consumed and TK is kept in operation being supplied power from $B_1$ and the operation of OPT is stopped.

State *e* represents a state in which $B_1$ is consumed and a power to TK is supplied from especially $B_2$.

State *f* represents a state in which $B_1$ is consumed and a power to TK is supplied and a power to OPT is supplied possibly from $B_2$.

In Table 1 the indication "1" and "0", respectively, shows a value for the function of state or connection and the indication "(1)" and "(0)" is a value showing the case in which the value 1 and 0 can be chosen, but in which the indicated value is preferable.

Table 2 below shows examples of the preferable connection by using logical equations.

Table 2

| Case 1 | Case 2 | Case 3 |
|---|---|---|
| $C_1 = \bar{J}_1$ | $C_1 = \bar{J}_1$ | $C_1 = \bar{J}_1$ |
| $C_2 = \bar{J}_2$ | $C_2 = \bar{J}_2$ | $C_2 = J_1$ |
| $C_3 = 0$ | $C_3 = 0$ | $C_3 = 0$ |
| $C_4 = \bar{J}_2 J_3$ | $C_4 = J_3$ | $C_4 = J_3$ |
| $C_5 = 0$ | $C_5 = 0$ | $C_5 = 0$ |
| $C_6 = 0$ | $C_6 = 0$ | $C_6 = 0$ |

Figure 2:
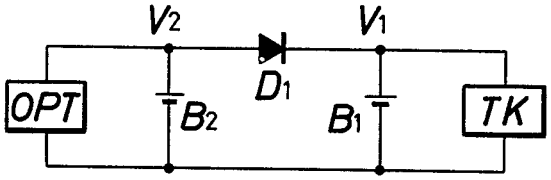
FIG. 2 is a circuit diagram of the timepiece embodying this invention.

In the circuit shown in FIG. 2 each of the electric cells $B_1$ and $B_2$ is a sivler oxide cell having a terminal voltage of 1.5 volts, the positive terminal thereof being mutually connected through a diode $D_1$ which has a small forward voltage drop characteristic, such as with a germanium or copper oxide diode. Also, the time keeping means TK is formed as a CMOS integrated circuit which can operate at a minimum voltage of 1.35 volts and has a power consumption rate of 3$\mu$A at 1.5 volts as well as the optional means OPT can operate at a minimum voltage of 1.35 volts and has a normal power consumption rate of 3$\mu$A and a working power consumption rate of 2mA.

When the capacity of the cell $B^2$ has been decreased in comparison with that of the cell $B_1$, the relation between the terminal voltages $V_1$ and $V_2$ of the cells $B_1$ and $B_2$ may be designated as follows:

$$V_1 - V_2 = \Delta V \geqq 0$$

In this case the diode $D_1$ is biased in the reverse direction and interrupts the electric current flowing from the cell $B_1$ to the cell $B_2$ and also the current from the cell $B_1$ to the optional means OPT, so that the cell $B_1$ can be prevented from the superfluous power consumption which may be required by the optional means OPT. On the contrary, when the cell $B_1$ is more consumed than the cell $B_2$ the electric current from the cell $B_2$ flows through the diode $D_1$ which is now forward biased to the cell $B_1$ thereby preventing the optional means OPT from operating defectively. The useful effects set forth above are secured except in rare cases such as when there is short-circuiting of the inside cell.

The diode $D_1$ used in the embodiment shown in FIG. 2 may be replaced with a resistor having a resistance of, for example, 1 to 10 K$\Omega$. In this case a good switching operation by means of the resistor is performed owing to the large ratio of the current flow between the time keeping means and the optional means OPT as well as in the resistance values between the cells and the resistance. Furthermore, the continuous working period of the time keeping means TK would be extended in comparison with the case using the cell $B_1$ only due to the fact that the time keeping means TK is operated by power from both cells $B_1$ and $B_2$ unless the optional means OPT is in operation.

Figure 3:
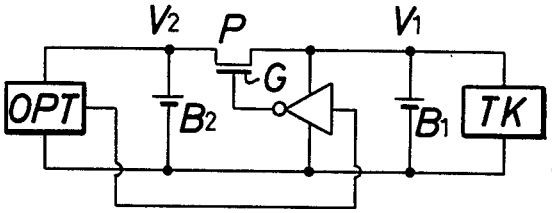
FIG. 3 is a circuit diagram of a second embodiment of a timepiece according to this invention.

FIG. 3 shows another embodiment of this invention in which a P channel field-effect transistor P of the enhancement type is used as a switching element in lieu of the diode $D_1$ of FIG. 2, the same or similar parts used in the embodiment shown in FIG. 2 being denoted by the same reference numerals and the detailed description thereof being omitted.

Under the normal condition a 0 level signal is supplied to the gate G of the transmitter P to turn it on. Accordingly, the electric cells $B_1$ and $B_2$ are mutually connected through the transistor P which has an ON-resistance Ron where the value of Ron is 300$\Omega$ and the internal resistance of both cells $B_1$ and $B_2$ is 100$\Omega$, ratio. The between the current from the cell $B_1$ to the time keeping means TK and the current from the cell $B_2$ to the time keeping means TK is rated at about 4:1, thereby obtaining a 25% longer continuous working period of the time keeping means TK in the case that the cell $B_1$ is used alone. In the event of the terminal voltage $V_1$ of the cell $B_1$ becoming lower than that of the cell $B_2$ or the internal resistance of the cell $B_1$ becoming larger than that of the cell $B_2$, the more stable and accurate operation of the time keeping means TK is expected. When the optional means OPT starts its own operation, an "1" level signal is supplied to the gate of the transistor P to cut off the route between the cells $B_1$ and $B_2$. Accordingly, no electric current flow occurs from the cell $B_1$ to the cell $B_2$ or from the cell $B_1$ to the optional means OPT.

The embodiment shown in FIG. 3 gives rise to a practical advantage in that a timepiece having a plurality of cells connected in parallel can be formed with a simpler construction because short-circuiting of a cell cannot occur.

Figure 4:
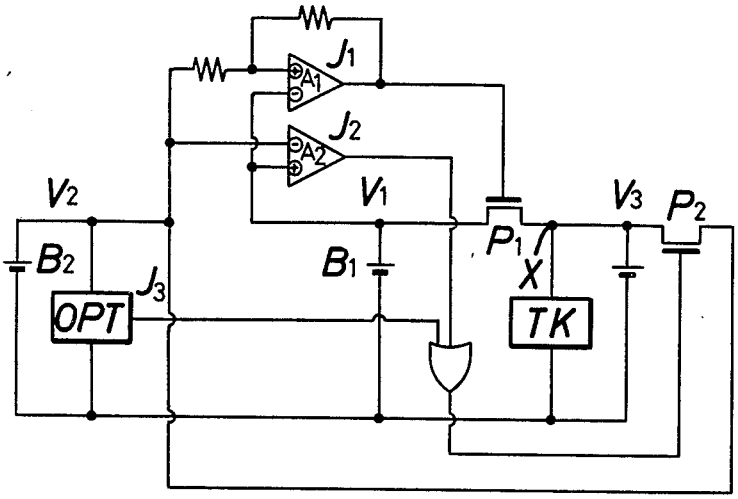
FIG. 4 is a circuit diagram of a third embodiment of a timepiece according to this invention.

In FIG. 4 there is shown a further embodiment of this invention including means for connecting the cells $B_1$ and $B_2$, other than that described as above, which can perform such operation that the time keeping means TK receives the power either from the cells $B_1$ and $B_2$ when the terminal voltage $V_1$ and $V_2$ are substantially equal or from one of the cells $B_1$ or $B_2$ when the difference $\Delta V$ between the voltage $V_1$ and $V_2$ is larger than a predetermined value. Furthermore the optional means OPT receives a power only from the cell $B_2$ until the cell $B_2$ is fully used. The selected mode of the connection in the system shown in FIG. 1 is given below:

$$C_1 = \overline{J}_1$$

$$C_2 = \overline{J}_1 . \overline{J}_2$$

$$C_4 = 1$$

$$C_3 = C_5 = C_6 = 0$$

In the system shown in FIG. 4 differencial amplifiers $A_1$ and $A_2$ generate logical output signals $J_1$ and $J_2$ having the level 1, respectively, when the voltages at the input terminals denoted by (+) and (−) have the following relation:

$$V_{(+)} - V_{(-)} > \Delta V$$

where: $\Delta V$ has a predetermnined value larger than zero.

The outputs $J_1$ and $J_2$ will take a level "0" in case other than the above.

The differential amplifiers $A_1$ and $A_2$ may be operated continuously or intermittently. In the latter case the amplifiers are controlled by the signal prepared by using the signal from the time keeping means TK and the outputs $J_1$ and $J_2$ are stored in a suitable memory and taken therefrom on demand. The combinations of the outputs $J_1$, $J_2$ and $J_3$ are as follows:

$$J_1 + J_2 = 0 \ldots V_1 \approx V_2$$

$$\overline{J}_1 . J_2 = 1 \ldots V_1 > V_2$$

$$J_1 . \overline{J}_2 = 1 \ldots V_1 < V_2$$

The optional means OPT has a function to generate an output signal $J_3$ of level 0 when OPT is in the operating state and level 1 at other times. The signals $J_1$, $J_2$ and $J_3$ are used to control a pair of P-channel switching transistors $P_1$ and $P_2$ in accordance with the level thereof, the relation between the level of the signals and the state of the transistors being given below:

$$P_1 = \overline{J}_1$$

$$P_2 = \overline{J}_2 . \overline{J}_3$$

The signals $J_1$ and $J_2$ may be utilized for the display of the capacity of the cells $B_1$ and $B_2$, respectively.

For the purpose of preventing the time keeping means TK from malfunction, it is recommended that a capacitor is connected between the point X and the negative terminal of the cell $B_1$. It is preferred to form a positive feedback loop from the output terminal to the input terminal of each of the differencial amplifiers $A_1$ and $A_2$ in order to obtain output signals having a hysteresis characteristic.

The preferred form the timepiece according to this invention has a space provided for enclosing a plurality of cells and a connecting system as described above in the interior of the casing. Alternatively, the timepiece may have a set of external connecting terminals to which the respective terminals of one or more additional electric cells and/or a connecting system is connectable. Such arrangement makes it possible to subjoin an additional cell or cells without opening the sealed casing of the timepiece.

Furthermore, the timepiece of this invention may be provided with means for connecting an optional component including a cell or cells therefor. In this case the timepiece can be formed comprising a main component and a cell or cells therefor, which is capable of being prepared as of a standard type to which one or more optional components with a cell therefor are connected on demand.

Preferably, the connecting system according to this invention is constituted in the form of a CMOS integrated circuit with or without the main component of the timepiece, the details being apparent to those skilled in the art.

What is claimed is:

1. An electronic timepiece comprising: a main component of said timepiece, at least one electric cell for said main component; an optional component, at least one electric cell for said optional component; a connecting system having a switching element for selectively connecting in parallel said cells for said main and optional components to each other, means for detecting the difference in the terminal voltage between said cells and means for controlling said switching element in accordance with the signal from said difference detecting means.

2. An electronic timepiece according to claim 1 wherein each of said difference detecting means is a differential amplifier, of which an output signal thereof is used for controlling said switching element.

3. An electronic timepiece according to claim 1 which further comprises means for controlling at least one of said difference detecting means to generate the output signal intermittently by using the timing signal prepared in accordance with the signal from said main component and a memory device for storing said signal from said difference detecting means.

4. An electronic timepiece according to claim 1 wherein each switching element is a field-effect transistor.

5. An electronic timepiece having time keeping means, and including a plurality of battery cells and connection means for connecting the battery cells to form current paths; wherein the electronic timepiece further comprises:

means for detecting the state of the time keeping means;

output means for producing a signal indicative of the state of said time keeping means;

at least one optional auxiliary component associated with said timepiece;

a plurality of circuit paths for connecting said auxiliary optional component to said battery cells, and for connecting said time keeping means to said battery cells;

selection means for selecting the circuit path to said auxiliary optional component from said battery cells, according to the state of the time keeping means, as indicated by the signal from the detecting means on the ouput means; and connecting means for connecting the circuit path selected by the selecting means.

6. The electronic timepiece of claim 5, wherein the connecting means is a diode.

7. The electronic timepiece of claim 5, wherein the selecting means is a field effect transistor.

8. The electronic timepiece of claim 5, wherein the connecting means includes:

means for establishing a parallel connection between the battery cells; and means for exteriorly effecting said parallel connection with an exterior operating member.

9. The electronic timepiece of claim 5, wherein the interior state of the timepiece is monitored intermittently by the detecting means..

10. The electronic timepiece of claim 5, wherein the means for detecting the state and the means for selecting the circuit paths has hysteresis input and output characteristics.

11. The electronic timepiece, according to claim 5, wherein the optional auxiliary components are selected from a group including:

a calculator:

an alarm device;

a high accuracy timepiece and signal generator;

an automatic time correcting device;

a paging device;

a data bank device; and a schedule timer device.

* * * * *